US008158315B2

(12) United States Patent
Wu

(10) Patent No.: US 8,158,315 B2
(45) Date of Patent: Apr. 17, 2012

(54) SN CONTAINING HOLE BLOCKING LAYER PHOTOCONDUCTOR

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 418 days.

(21) Appl. No.: 12/511,139

(22) Filed: Jul. 29, 2009

(65) Prior Publication Data

US 2011/0027707 A1 Feb. 3, 2011

(51) Int. Cl.
*G03G 5/14* (2006.01)

(52) U.S. Cl. ..... 430/58.8; 430/64; 430/65; 430/60; 430/58.75

(58) Field of Classification Search ..... 430/64, 430/65, 60, 58.8, 58.75
See application file for complete search history.

(56) References Cited

U.S. PATENT DOCUMENTS

| | | | | | |
|---|---|---|---|---|---|
| 4,273,846 | A | * | 6/1981 | Pai et al. | 430/58.75 |
| 4,464,450 | A | * | 8/1984 | Teuscher | 430/65 |
| 4,921,769 | A | | 5/1990 | Yuh et al. | |
| 5,244,762 | A | * | 9/1993 | Spiewak et al. | 430/64 |
| 5,473,064 | A | | 12/1995 | Mayo et al. | |
| 5,482,811 | A | | 1/1996 | Keoshkerian et al. | |
| 5,521,306 | A | | 5/1996 | Burt et al. | |
| 5,635,324 | A | * | 6/1997 | Rasmussen et al. | 430/64 |
| 6,913,863 | B2 | | 7/2005 | Wu et al. | |
| 7,037,631 | B2 | | 5/2006 | Wu et al. | |
| 7,732,111 | B2 | * | 6/2010 | Wu et al. | 430/64 |
| 2005/0058919 | A1 | * | 3/2005 | Tong et al. | 430/64 |
| 2006/0105254 | A1 | | 5/2006 | Wu | |
| 2007/0149639 | A1 | * | 6/2007 | Horikoshi et al. | 523/102 |
| 2009/0035675 | A1 | | 2/2009 | Wu | |
| 2011/0027705 | A1 | | 2/2011 | Wu | |
| 2011/0027706 | A1 | | 2/2011 | Wu et al. | |
| 2011/0027708 | A1 | | 2/2011 | Wu | |

OTHER PUBLICATIONS

Jin Wu et al, U.S. Appl. No. 12/394,343 on Epoxy Carboxyl Resin Mixture Hole Blocking Layer Photoconductors, filed Feb. 27, 2009.
Jin Wu, U.S. Appl. No. 12/129,948 on Aminosilane and Self Crosslinking Acrylic Resin Hole Blocking Layer Photoconductors, filed May 30, 2008.
Jin Wu, U.S. Appl. No. 12/164,338 on Phenolic Resin Hole Blocking Layer Photoconductors, filed Jun. 30, 2008.

* cited by examiner

*Primary Examiner* — Christopher Rodee
(74) *Attorney, Agent, or Firm* — Oliff & Berridge, PLC

(57) ABSTRACT

A photoconductor that includes a supporting substrate, a hole blocking layer, a ground plane layer, a photogenerating layer, and at least one charge transport layer, and where the hole blocking layer includes a SN containing compound and an aminosilane.

33 Claims, No Drawings

SN CONTAINING HOLE BLOCKING LAYER PHOTOCONDUCTOR

CROSS REFERENCE TO RELATED APPLICATIONS

Illustrated in copending U.S. application Ser. No. 12/511,128, U.S. Publication No. 20110027705, filed Jul. 29, 2009 on Epoxysilane Polymer Hole Blocking Layer Photoconductors, the disclosure of which are totally incorporated herein by reference, is a photoconductor comprising a substrate, a ground plane layer, an undercoat layer thereover, and wherein the undercoat layer comprises an aminosilane and an epoxysilane; a photogenerating layer, and a charge transport layer.

Illustrated in copending U.S. application Ser. No. 12/511,133, U.S. Publication No. 20110027706, filed Jul. 29, 2009 on Melamine Polymer Hole Blocking Layer Photoconductors, the disclosure of which are totally incorporated herein by reference, is a photoconductor comprising a substrate; a ground plane layer; an undercoat layer thereover, and wherein the undercoat layer comprises an aminosilane and a melamine polymer; a photogenerating layer, and a charge transport layer.

Illustrated in copending U.S. application Ser. No. 12/511,146, U.S. Publication No. 20110027708, filed Jul. 29, 2009 on Aminosilane Urea Containing Hole Blocking Layer Photoconductors, the disclosure of which is totally incorporated herein by reference, is a photoconductor comprising a substrate, a ground plane layer, an undercoat layer thereover, and wherein the undercoat layer comprises an aminosilane and a urea resin; a photogenerating layer, and a charge transport layer.

U.S. application Ser. No. 12/394,343, U.S. Publication No. 20100221651, filed Feb. 27, 2009 on Epoxy Carboxyl Resin Mixture Hole Blocking Layer Photoconductors, the disclosure of which is totally incorporated herein by reference, illustrates a photoconductor comprising a substrate; an undercoat layer thereover wherein the undercoat layer comprises a metal oxide, and a mixture of an epoxy resin and a carboxyl resin; a photogenerating layer; and at least one charge transport layer.

U.S. application Ser. No. 12/164,338, U.S. Publication No. 20090325090, filed Jun. 30, 2008 on Phenolic Resin Hole Blocking Layer Photoconductors, the disclosure of which is totally incorporated herein by reference, illustrates a photoconductor comprising a substrate, a ground plane layer, an undercoat layer thereover wherein the undercoat layer comprises an aminosilane and a phenolic resin, a photogenerating layer, and a charge transport layer.

Illustrated in copending U.S. application Ser. No. 12/129,948, now U.S. Pat. No. 8,048,601 on Aminosilane and a Self Crosslinking Acrylic Resin Hole Blocking Layer Photoconductors, filed May 30, 2008, the disclosure of which is totally incorporated herein by reference, is a photoconductor comprising a substrate; a ground plane layer; an undercoat layer thereover wherein the undercoat layer comprises an aminosilane and a crosslinked acrylic resin; a photogenerating layer; and at least one charge transport layer.

Illustrated in copending U.S. application Ser. No. 11/831,469, U.S. Publication No, 20090035675, now U.S. Pat. No. 7,867,676, filed Jul. 11, 2007, entitled Copper Containing Hole Blocking Layer Photoconductors, the disclosure of which is totally incorporated herein by reference, is a photoconductor comprising a substrate; an undercoat layer thereover wherein the undercoat layer comprises a metal oxide, and a copper containing compound; a photogenerating layer; and at least one charge transport layer.

High photosensitivity titanyl phthalocyanines are illustrated in copending U.S. application Ser. No. 10/992,500, U.S. Publication No. 20060105254, now U.S. Pat. No. 7,947,417, the disclosure of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, such as the supporting substrates, resin binders, antioxidants, charge transport components, titanyl phthalocyanines, high photosensitivity titanyl phthalocyanines, such as Type V, hydroxygallium phthalocyanines, adhesive layers, aminosilanes, and the like, may be selected for the photoconductors and imaging members of the present disclosure in embodiments thereof.

BACKGROUND

This disclosure is generally directed to layered imaging members, photoreceptors, photoconductors, and the like. More specifically, the present disclosure is directed to multilayered drum, or flexible, belt imaging members, or devices comprised of a supporting medium like a substrate; a ground plane layer; a hole blocking layer comprised of an aminosilane, and a SN, especially a S═N, containing compound; a photogenerating layer; and a charge transport layer, including at least one or a plurality of charge transport layers, and wherein at least one charge transport layer is, for example, from 1 to about 7, from 1 to about 3, and one; and more specifically, a first charge transport layer and a second charge transport layer. More specifically, there are disclosed herein photoconductors that contain a hole blocking layer in contact with a gold ground plane, and wherein the hole blocking layer is comprised of a SN compound and an aminosilane.

In embodiments, photoconductors comprised of the disclosed ground plane, especially a gold ground player layer, and a SN containing hole blocking or undercoat layer enables, for example, the blocking of or minimization of the movement of holes or positive charges generated from the ground plane layer; excellent cyclic stability, and thus color print stability especially for xerographic generated color copies. Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 200 kilocycles, or xerographic prints of, for example, from about 80 to about 200 kiloprints. Excellent color print stability refers, for example, to substantially no or minimal change in solid area density, especially in 60 percent halftone prints, and no or minimal random color variability from print to print after a number of xerographic prints, for example 50 kiloprints.

Further, in embodiments, the photoconductors disclosed may, it is believed, permit the minimization or substantial elimination of undesirable ghosting on developed images, such as xerographic images, including minimal ghosting at various relative humidities; excellent cyclic and stable electrical properties; acceptable charge deficient spots (CDS); and compatibility with the photogenerating and charge transport resin binders, such as polycarbonates. Charge blocking layer and hole blocking layer are generally used interchangeably with the phrase "undercoat layer".

In embodiments, there is selected for the photoconductor a gold ground plane in place of a Zr/Ti ground plane since, for example, gold is substantially free of oxidation, and thus provides excellent electrical stability during xerographic cycling. Photoconductors that contain a single Zr/Ti hole blocking layer of a thin oxide layer may, in several instances, be somewhat insufficient to block holes from a gold ground plane layer.

Also, included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 7,037,631 a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863 a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

In U.S. Pat. No. 4,921,769 there are illustrated photoconductive imaging members with blocking layers of certain polyurethanes.

Illustrated in U.S. Pat. No. 5,521,306 is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811 is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064 there is illustrated a process for the preparation of photogenerating pigments of hydroxygallium phthalocyanine Type V essentially free of chlorine.

EMBODIMENTS

Aspects of the present disclosure relate to a photoconductor comprising a substrate, a first layer, and an undercoat layer thereover, and wherein the undercoat layer comprises an aminosilane and a SN containing compound; a photogenerating layer, and a charge transport layer, and wherein the SN containing compound is, for example, at least one of

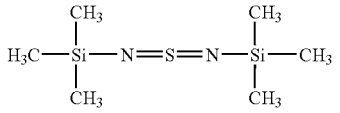

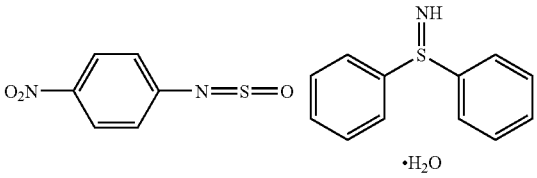

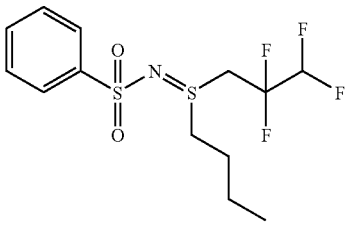

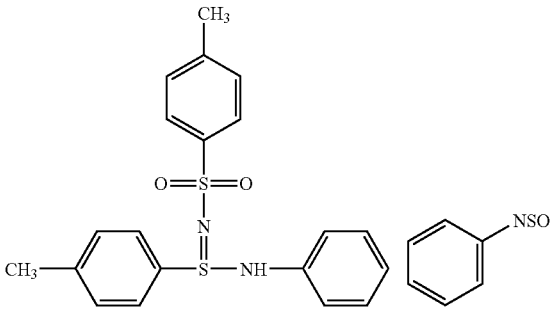

-continued

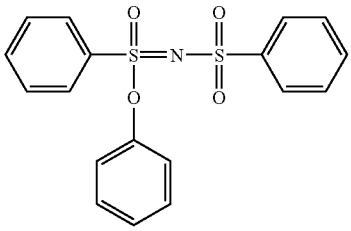

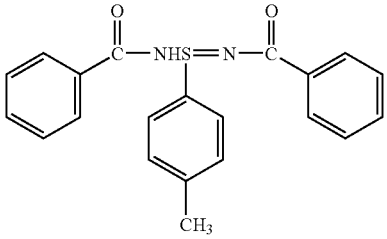

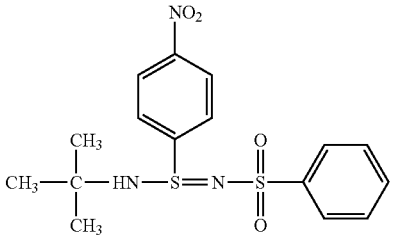

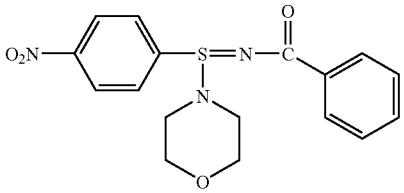

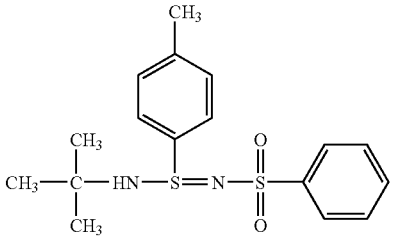

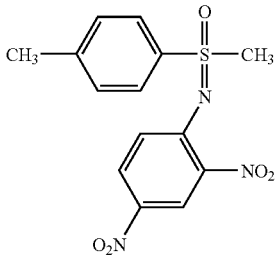

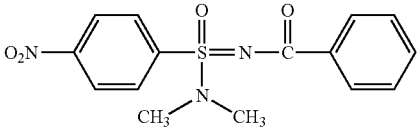

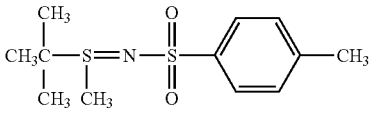

-continued

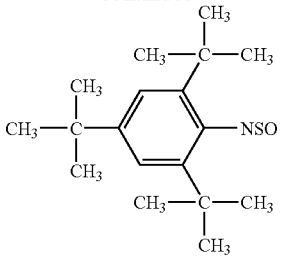

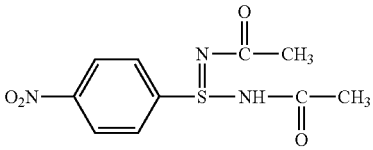

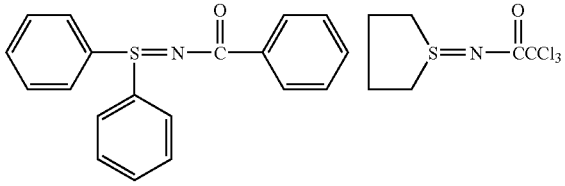

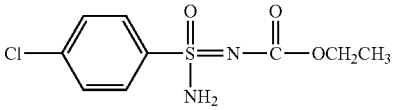

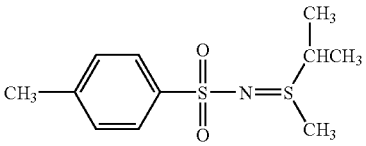

and

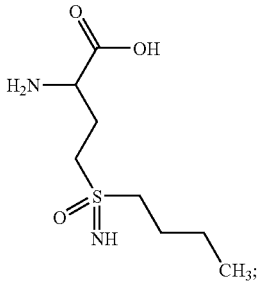

a photoconductor comprising a substrate, a gold ground plane layer, an undercoat layer thereover comprised of a mixture of an aminosilane and a compound selected from the group consisting of N,N'-bis(trimethylsilyl)sulfur diimide, N-thionylaniline, 4-nitro-N-sulfinylaniline, S,S-diphenylsulfilimine monohydrate, and N-(S-butyl(S-2,2,3,3-tetrafluoropropyl))-sulfanylidene)benzenesulfonamide, a photogenerating layer, and at least one charge transport layer; and a photoconductor comprising in sequence a supporting substrate, a gold ground plane layer, a hole blocking layer comprised of a mixture of an aminosilane and N,N'-bis(trimethylsilyl)sulfur diimide, N-thionylaniline, 4-nitro-N-sulfinylaniline, S,S-diphenylsulfilimine monohydrate, or N-(S-butyl(S-2,2,3,3-tetrafluoropropyl)-sulfanylidene) benzenesulfonamide; a photogenerating layer, and a charge transport layer; a photoconductor comprising a supporting substrate, a gold ground plane layer, a hole blocking layer comprised of a mixture of an aminosilane, and a SN compound, a photogenerating layer comprised of at least one photogenerating pigment, and at least one charge transport layer comprised of at least one charge transport component; a flexible photoconductive member comprised in sequence of a supporting substrate, a gold ground plane layer, a hole blocking or undercoat layer that includes a mixture of a SN containing compound and an aminosilane, a photogenerating layer thereover comprised of at least one photogenerating pigment, and a charge, especially a hole, transport layer; and a photoconductor which includes a hole blocking layer, a gold ground plane layer, and an adhesive layer where the adhesive layer is situated between the hole blocking layer and the photogenerating layer; a photoconductor comprising a supporting substrate, a gold ground plane layer, a hole blocking layer as illustrated herein, a photogenerating layer, and at least one charge transport layer comprised of at least one charge transport component; a photoconductor comprising a gold ground plane layer, a hole blocking layer in contact with and deposited on the ground plane, a photogenerating layer, and a hole transport layer, and wherein the photogenerating layer comprises a hydroxygallium phthalocyanine or a high sensitivity titanyl phthalocyanine, and where the hole blocking layer comprises a SN containing compound selected from the group consisting of N-thionylaniline, 4-nitro-N-sulfinylaniline, N,N'-bis(trimethylsilyl)sulfur diimide, S,S-diphenylsulfilimine monohydrate, N-(S-butyl(S-2,2,3,3-tetrafluoropropyl))-sulfanylidene)benzene sulfonamide, and the like; a photoconductor wherein the SN containing compound is present in an amount of from about 0.1 to about 35 weight percent, from 1 to about 20 weight percent, from 5 to about 15 weight percent, and more specifically, about 10 weight percent; and a photoconductor comprising a supporting substrate, a gold ground plane layer, a hole blocking layer as illustrated herein, a photogenerating layer, and a hole transport layer; and wherein the photogenerating layer comprises a high sensitivity titanyl phthalocyanine; a photoconductor comprising a supporting media like a known photoconductor substrate, a ground plane layer, an undercoat layer thereover, and in contact with the hole blocking layer, a photogenerating layer and in contact with the photogenerating layer, a charge transport layer; a photoconductor comprising in sequence a substrate layer, a ground plane layer, an hole blocking layer in contact with the ground plane layer, and which hole blocking layer is comprised of a mixture of an aminosilane and a S═N containing component, a photogenerating layer in contact with the hole blocking layer, and at least charge transport layer, such as 1, 2, or 3 charge transport layers in contact with the photogenerating layer.

Ground Plane Layer Examples

Examples of ground plane layers are aluminum, titanium, titanium/zirconium, gold, and other known suitable components. The thickness of the metallic ground plane is, for example, from about 10 to about 100 nanometers. Specifically, the gold ground plane, in embodiments, is from about 20 to about 50 nanometers, and more specifically, from about 25 to about 45 nanometers, and more specifically, about 35 nanometers in thickness, and the titanium or titanium/zirconium ground plane when selected is, for example, from about 10 to about 30 nanometers, and more specifically, about 20 nanometers in thickness.

Hole Blocking Layer Examples

The hole blocking layer, which is usually in contact with and coated on the ground plane layer, is comprised, for example, of a SN compound, and an aminosilane.

Specific examples of SN compounds for incorporation into the hole blocking layer are as illustrated herein, and include N,N'-bis(trimethylsilyl)sulfur diimide, N-thionylaniline, 4-nitro-N-sulfinylaniline, S,S-diphenylsulfilimine monohydrate, N-(S-butyl(S-2,2,3,3-tetrafluoropropyl))-sulfanylidene)benzenesulfonamide, and the like.

In embodiments, the SN, especially S═N where ═ represents a double chemical bond, containing compound can be represented by

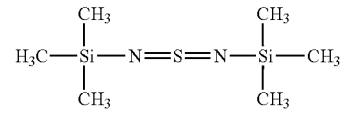

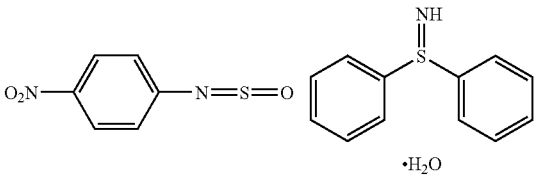

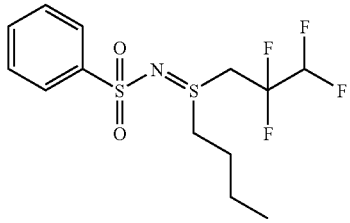

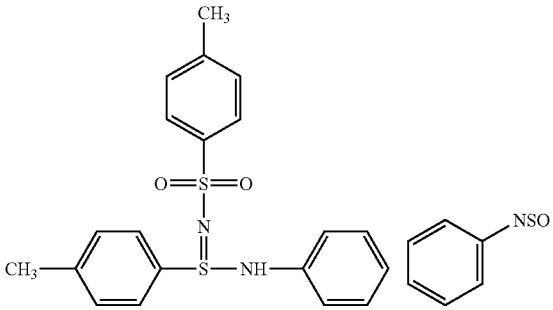

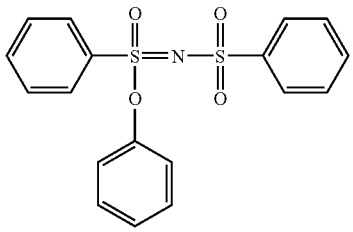

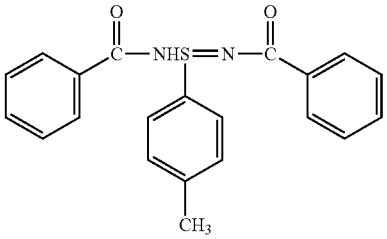

-continued

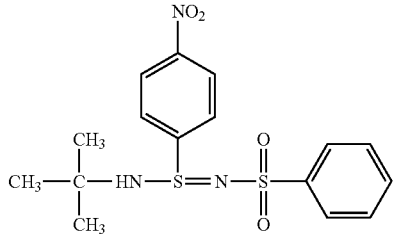

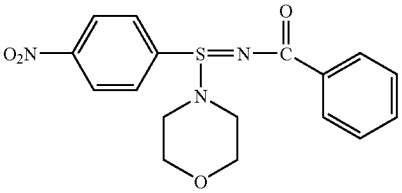

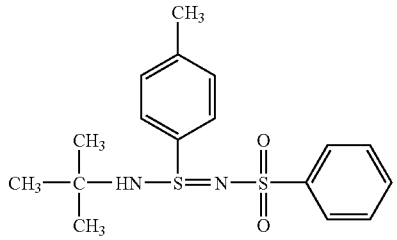

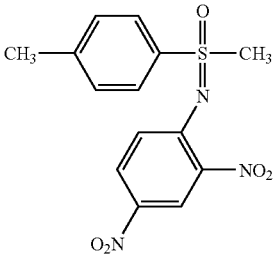

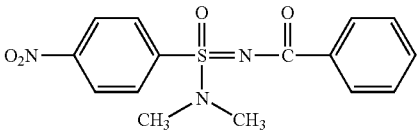

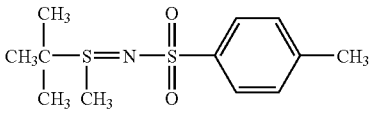

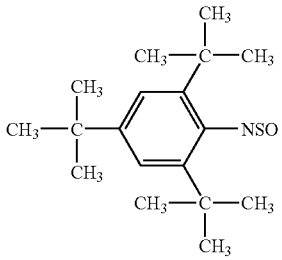

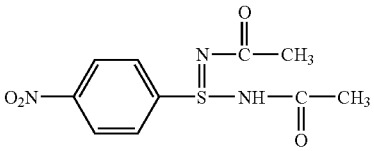

-continued

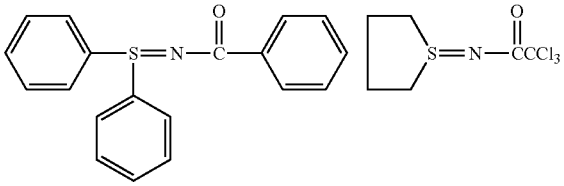

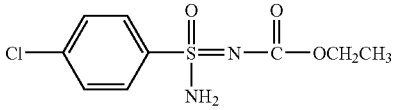

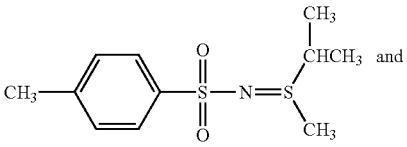

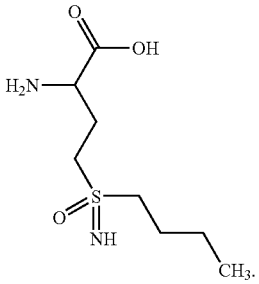

The hole blocking layer also includes, in addition to the SN containing compound, an aminosilane or mixtures thereof. Aminosilane examples included in the hole blocking layer can be represented by

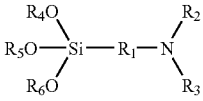

wherein $R_1$ is an alkylene group containing, for example, from 1 to about 25 carbon atoms; $R_2$ and $R_3$ are independently selected from the group consisting of at least one of hydrogen, alkyl containing, for example, from 1 to about 12, and more specifically, from 1 to about 4 carbon atoms; aryl with, for example, from about 6 to about 42 carbon atoms, such as a phenyl group; and a poly(alkylene like ethylene amino) group; and $R_4$, $R_5$, and $R_6$ are independently selected from an alkyl group containing, for example, from 1 to about 10, and more specifically, from 1 to about 4 carbon atoms.

Aminosilane specific examples include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8 can be selected. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

There can be further included in the undercoat or hole blocking layer a number of polymer binders, such as for example polyacetal resins, such as polyvinyl butyral resins, glycoluril resins, benzoguanamine resins, or mixtures of these resins, and which resins or mixtures of resins function primarily to disperse the mixture of the aminosilane and the SN containing compound; and other known suitable components may also be present in the undercoat.

Polymer Bimder Examples

Undercoat layer examples of benzoguanamine binder resins can be represented by

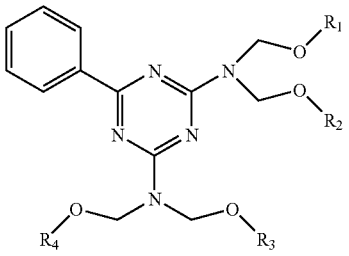

wherein $R_1$, $R_2$, $R_3$ and $R_4$ each independently represents a hydrogen atom or an alkyl group as illustrated herein. In embodiments, the benzoguanamine resin is water soluble, dispersible, or indispersible. The benzoguanamine resin can be highly alkylated/alkoxylated, partially alkylated/alkoxylated, or a mixed alkylated/alkoxylated material. Specific examples of the benzoguanamine resin include methylated, n-butylated, or isobutylated, with examples of the benzoguanamine resin being CYMEL® 659, 5010, 5011. CYMEL® benzoguanamine resins are commercially available from CYTEC Industries, Inc. Benzoguanamine resin examples can be generally comprised of amino resins generated from benzoguanamine, and formaldehyde. Benzoguanamine resins are known under various trade names including, but not limited to CYMEL®, BEETLE™, and UFORMITE™.

Glycoluril resin undercoat binder examples are

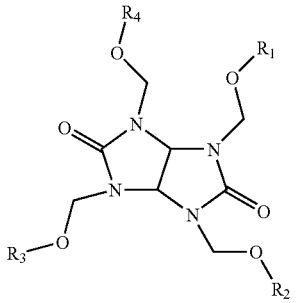

wherein $R_1$, $R_2$, $R_3$, and $R_4$ each independently represents a hydrogen atom or an alkyl group as illustrated herein with, for example, 1 to about 8 carbon atoms, or with 1 to about 4 carbon atoms. The glycoluril resin can be water soluble, dispersible, or indispersible. Examples of the glycoluril resin include highly alkylated/alkoxylated, partially alkylated/alkoxylated, or mixed alkylated/alkoxylated, and more specifically, the glycoluril resin can be methylated, n-butylated, or isobutylated. Specific examples of the glycoluril resin include CYMEL® 1170, 1171. CYMEL® glycoluril resins are commercially available from CYTEC Industries, Inc. Glycoluril resins are amino resins obtained from glycoluril and formaldehyde, and are known under various trade names including, but not limited to CYMEL® and POWDERLINK™.

In embodiments, polyacetal resin hole blocking or undercoat layer binders include polyvinyl butyrals formed by the well-known reactions between aldehydes and alcohols. The addition of one molecule of an alcohol to one molecule of an aldehyde produces a hemiacetal. Hemiacetals are rarely isolated because of their inherent instability, but rather are further reacted with another molecule of alcohol to form a stable acetal. Polyvinyl acetals are prepared from aldehydes and polyvinyl alcohols. Polyvinyl alcohols are high molecular weight resins containing various percentages of hydroxyl and acetate groups produced by hydrolysis of polyvinyl acetate. The conditions of the acetal reaction and the concentration of the particular aldehyde and polyvinyl alcohol used are controlled to form polymers containing predetermined proportions of hydroxyl groups, acetate groups, and acetal groups.

Polyvinyl butyral resin binders selected can be represented by

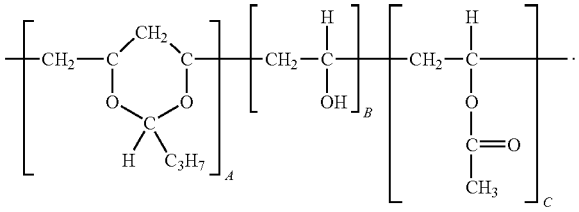

The proportions of polyvinyl butyral (A), polyvinyl alcohol (B), and polyvinyl acetate (C) are controlled, and are randomly distributed along the molecule. The mole percent of polyvinyl butyral (A) is from about 50 to about 95, that of polyvinyl alcohol (B) is from about 5 to about 30, and that of polyvinyl acetate (C) is from about 0 to about 10. In addition to vinyl butyral (A), other vinyl acetals can be optionally present in the molecule including vinyl isobutyral (D), vinyl propyral (E), vinyl acetacetal (F), and vinyl formal (G). The total mole percent of all the monomeric units in one molecule is about 100.

Examples of specific hole blocking layer polyvinyl butyrals include BUTVAR™ B-72 ($M_w$=170,000 to 250,000, A=80, B=17.5 to 20, C=0 to 2.5), B-74 ($M_w$=120,000 to 150,000, A=80, B=17.5 to 20, C=0 to 2.5), B-76 ($M_w$=90,000 to 120,000, A=88, B=11 to 13, C=0 to 1.5), B-79 ($M_w$=50,000 to 80,000, A=88, B=10.5 to 13, C=0 to 1.5), B-90 ($M_w$=70,000 to 100,000, A=80, B=18 to 20, C=0 to 1.5), and B-98 ($M_w$=40,000 to 70,000, A=80, B=18 to 20, C=0 to 2.5), all commercially available from Solutia, St. Louis, Mo.; S-LEC™ BL-1 (degree of polymerization=300, A=63±3, B=37, C=3), BM-1 (degree of polymerization=650, A=65±3, B=32, C=3), BM-S (degree of polymerization=850, A>=70, B=25, C=4 to 6), BX-2 (degree of polymerization=1,700, A=45, B=33, G=20), all commercially available from Sekisui Chemical Co., Ltd., Tokyo, Japan.

The hole blocking layer can contain a single resin binder, a mixture of resin binders, such as from 2 to about 7, from 3 to about 5, and the like, and where for the mixtures the percentage amounts selected for each resin varies, providing that the mixture contains about 100 percent by weight of the first and second resin, or the first, second, and third resin.

The hole blocking layer can, in embodiments, be prepared by a number of known methods, the process parameters being dependent, for example, on the photoconductor member desired. The hole blocking layer can be coated as a solution or a dispersion onto the supporting substrate or the ground plane layer by the use of a spray coater, dip coater, extrusion coater, roller coater, wire-bar coater, slot coater, doctor blade coater, gravure coater, and the like, and dried at, for example, from about 40° C. to about 200° C. for a suitable period of time, such as from about 1 minute to about 10 hours, under stationary conditions or in an air flow. The coating can be accomplished to provide a final hole blocking layer coating thickness of, for example, from about 0.01 to about 30 microns, or from 0.02 to about 5 microns, or from about 0.03 to about 0.5 micron after drying.

In embodiments, the hole blocking layer is comprised of an aminosilane present, for example, in an amount of from about 60 to about 99.9 weight percent, and a SN containing compound present, for example, in an amount of from about 0.1 to about 40 weight percent. More specifically, the hole blocking layer is comprised of an aminosilane present in an amount of from about 80 to about 99 weight percent, and a S═N containing compound present in an amount of from about 1 to about 20 weight percent, from 2 to about 15 weight percent, from 3 to about 10 weight percent, and wherein the total of the aminosilane and the S═N compound is about 100 percent.

Photoconductor Layer Examples

The thickness of the photoconductor substrate layer depends on many factors, including economical considerations, electrical characteristics, adequate flexibility, availability, and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent and may comprise any suitable material including known or future developed materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Examples of electrically conductive layers or ground plane layers usually present on nonconductive substrates are gold, gold containing compounds, aluminum, titanium, titanium/zirconium, and other known suitable know components. The thickness of the metallic ground plane is, for example, from about 10 to about 100 nanometers; from about 20 to about 50 nanometers, and more specifically, about 35 nanometers, and the titanium or titanium/zirconium ground plane is, for example, from about 10 to about 30, and more specifically, about 20 nanometers in thickness.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly (vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40 to about 150° C. for about 15 to about 90 minutes. More specifically, a photogenerating layer of a thickness, for example, of from about 0.1 to about 10 microns, or from about 0.2 to about 2 microns can be applied to or deposited on the substrate, on other surfaces in between the substrate and the charge transport layer, and the like. The charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer and a charge transport layer or plurality of charge transport layers is formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of charge transport compounds can be included in the charge transport layer, which layer generally is of a thickness of from about 5 to about 75 microns, and more specifically, of a thickness of from about 10 to about 40 microns. Examples of charge transport components are aryl amines of the following formulas/structures

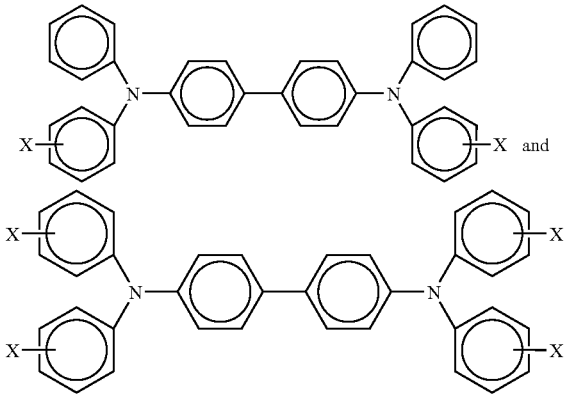

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

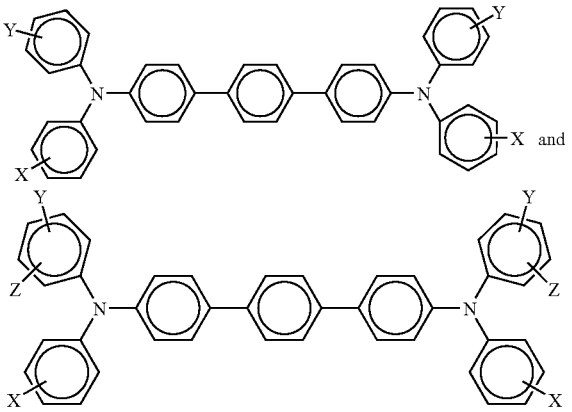

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1-biphenyl-4,4'-diamine wherein the halo substituent is a chloro substituent; N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 to about 50 percent by weight of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material or a combination of a small molecule charge transport material and a polymeric charge transport material, Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 microns, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional overcoating may be applied over the charge transport layer to provide abrasion protection.

In embodiments, the present disclosure relates to a photoconductive imaging member comprised of a gold or a gold containing ground plane layer, a hole blocking layer, a photogenerating layer, a charge transport layer, and an overcoating charge transport layer; a photoconductive member with a photogenerating layer of a thickness of from about 0.1 to about 8 microns, and at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of an ACBC (anticurlback coating) layer, a supporting substrate, a ground plane layer, a hole blocking layer, and thereover a photogenerating layer comprised of a photogenerating pigment, and a charge transport layer or layers, and thereover an overcoating charge transport layer, and where the transport layer is of a thickness of from about 40 to about 75 microns; a member wherein the photogenerating layer contains a photogenerating pigment present in an amount of from about 8 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a titanyl phthalocyanine or a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, aluminized polyethylene naphthalate, titanized polyethylene terephthalate, titanized polyethylene naphthalate, titan ized/zirconized polyethylene terephthalate, titanized/zirconized polyethylene naphthalate, goldized polyethylene terephthalate, or goldized polyethylene naphthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers comprises

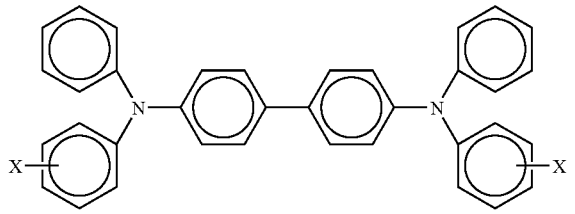

wherein X is selected from the group consisting or alkyl, alkoxy, aryl, and halogen; and wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

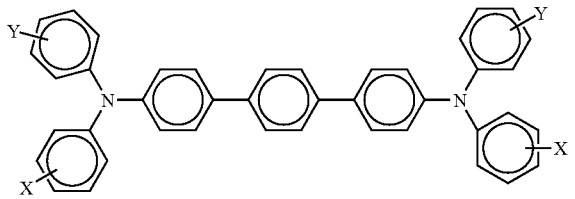

wherein X and Y are independently alkyl, alkoxy, aryl, a halogen, or mixtures thereof; an imaging member wherein alkyl and alkoxy contain from about 1 to about 10 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine photogenerating pigment has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the supporting substrate, which has deposited thereon the hole blocking layer illustrated herein, and the charge transport; a member wherein the charge transport layer is situated between the substrate and the photogenerating layer; a member wherein the photogenerating layer is of a thickness of from about 0.1 to about 50 microns; a member wherein the photogenerating pigment is dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, Type V titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; a photoconductor wherein the photogenerating layer contains an alkoxygallium phthalocyanine; photoconductive imaging members comprised of a supporting substrate, a photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

In embodiments, the charge transport component can be represented by the following formulas/structures

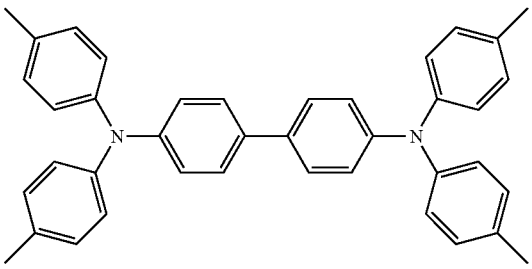

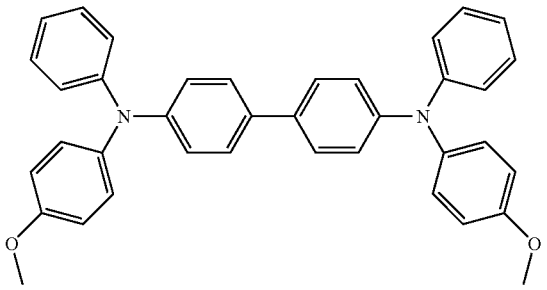

-continued

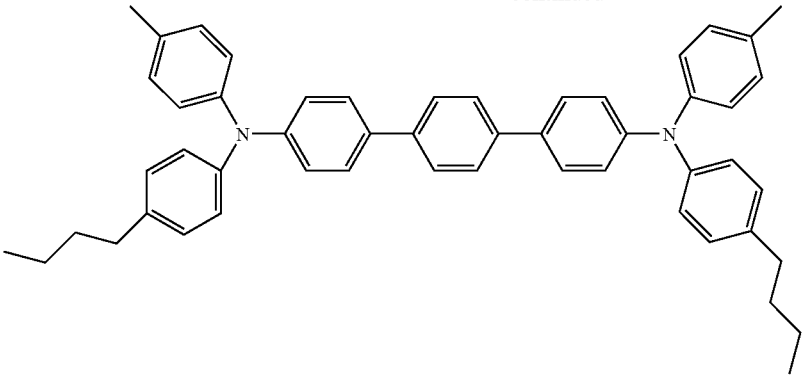

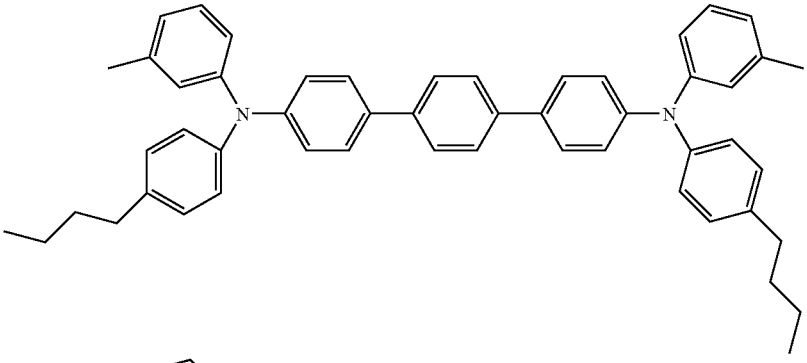

and

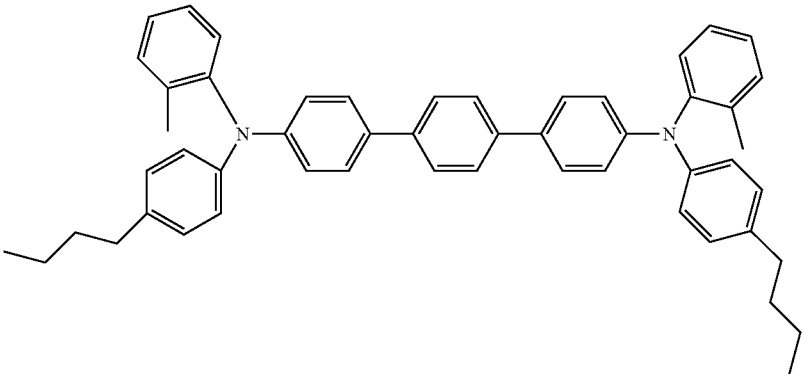

The following Examples are being submitted to illustrate embodiments of the present disclosure.

Comparative Example 1

A ground plane layer of zirconium/titanium was prepared by vacuum sputtering or vacuum evaporation of a 0.02 micron thick zirconium/titanium metal layer onto a biaxially oriented polyethylene naphthalate substrate (KALEDEX™ 2000) having a thickness of 3.5 mils.

Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 0.04 micron. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 0.02 micron.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the hydroxygallium phthalocyanine dispersion. The slurry resulting was then placed on a shaker for 10 minutes. The resulting dispersion was, thereafter, applied to the above adhesive interface with a Bird applicator to form a photogenerating layer having a wet thickness of 0.50 mil. The photogenerating layer was dried at 120° C. for 1 minute in a forced air oven to form a dry photogenerating layer having a thickness of 0.8 micron.

The photogenerating layer was then coated with a single charge transport layer prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_w$ molecular weight average of about 120,000, commercially available from Farbenfabriken Bayer A. G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

Comparative Example 2

A photoconductor was prepared by repeating the above process of Comparative Example 1 except in place of the zirconium/titanium ground plane there was selected a 0.035 micron gold ground plane deposited onto a biaxially oriented polyethylene naphthalate substrate (KALEDEX™ 2000) having a thickness of 3.5 mils via vacuum sputtering or vacuum evaporation.

Example I

A photoconductor was prepared by repeating the process of Comparative Example 2 except that the hole blocking layer solution was prepared by adding 10 weight percent of N,N'-bis(trimethylsilyl)sulfur diimide (SN containing compound) to the hole blocking layer coating solution. The resulting hole blocking layer dispersion was then coated and dried (120° C./1 minute) on the gold ground plane resulting in a hole blocking layer with a final thickness of 0.04 micron. The hole blocking layer was comprised of 10 weight percent of N,N'-bis(trimethylsilyl)sulfur diimide and 90 weight percent of 3-aminopropyl triethoxysilane (γ-APS).

Example II

A number of photoconductors are prepared by repeating the process of Comparative Example 2 except that the hole blocking layer solutions are prepared by adding 10 weight of N-thionylaniline, 4-nitro-N-sulfinylaniline, S,S-diphenylsulfilimine monohydrate, or N—(S-butyl(S-2,2,3,3-tetrafluoropropyl))-sulfanylidene)benzenesulfonamide in the hole blocking layer coating solution. The hole blocking layers are coated and dried (120° C./1 minute) on the gold ground plane layers with hole blocking layer final thicknesses of 0.04 micron.

The four hole blocking layers are comprised of 10 weight percent of N-thionylaniline, 4-nitro-N-sulfinylaniline, S,S-diphenylsulfilimine monohydrate, or N-(S-butyl(S-2,2,3,3-tetrafluoropropyl))-sulfanylidene)benzenesulfonamide, and 90 weight percent of 3-aminopropyl triethoxysilane (γ-APS).

Electrical Property Testing

The above prepared three photoconductors of Comparative Examples 1 and 2, and Examples I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductor devices were tested at a surface potential of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Almost identical PIDC curves were obtained, and the hole blocking layer containing the SN compound and aminosilane did not adversely affect the electrical properties of the Example I photoconductor.

Charge Deficient Spots (CDS) Measurements

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member or photoconductor. The method of U.S. Pat. No. 5,703,487, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

More specifically, U.S. Pat. Nos. 6,008,653 and 6,150,824, the disclosures of each patent being totally incorporated herein by reference, disclose a method for detecting surface potential charge patterns in an electrophotographic imaging member with a floating probe scanner. A Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, and a floating fixture which maintains a substantially constant distance between the probe and the imaging surface. A constant voltage charge is applied to the imaging surface (photoconductor) prior to relative movement of the probe and the imaging surface past each other, and the probe is synchronously biased to within about ±300 volts of the average surface potential of the imaging surface to prevent breakdown, while measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts may be selected to count charge deficient spots (CDS). The above prepared photoconductors (Comparative Examples 1 and 2, and Example I) were measured for CDS counts using the above-described FPS technique, and the results follow in Table 1.

TABLE 1

| | Ground Plane | CDS (Counts/cm$^2$) |
|---|---|---|
| Comparative Example 1 with Aminosilane Hole Blocking Layer | Ti/Zr | 18 |
| Comparative Example 2 with Aminosilane Hole Blocking Layer | Gold | 132 |
| Example I with Aminosilane/SN Hole Blocking Layer | Gold | 20 |

The aminosilane hole blocking layer blocked most holes from the Ti/Zr ground plane thus resulting in low CDS counts, specifically about 18 counts/cm$^2$ for Comparative Example 1. However, the same hole blocking layer was insufficient to block holes from a gold ground plane resulting in high CDS counts, specifically about 132 counts/cm$^2$ of Comparative Example 2.

With a gold ground plane, the above data with the SN compound incorporated into the aminosilane hole blocking layer improved hole blocking. As a result, by incorporating the above SN compound into the aminosilane hole blocking layer (Example I), the CDS counts were reduced to about 20 counts/cm$^2$ from 132 counts/cm$^2$ of the aminosilane hole blocking layer (Comparative Example 2) on gold, which were very comparable to that of the aminosilane hole blocking layer deposited on a Ti/Zr ground plane of Comparative Example 1.

Thus, incorporation of the SN containing compound and aminosilane into the hole blocking layer substantially reduced the CDS counts, especially for the gold ground plane, and thereby resulted in xerographic images of excellent resolution and with minimal ghosting characteristics.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate, a first layer, and an undercoat layer thereover, and wherein the undercoat layer comprises an aminosilane and a SN containing compound; a photogenerating layer, and a charge transport layer, and wherein the SN containing compound is at least one of

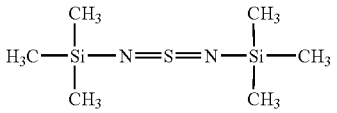

-continued

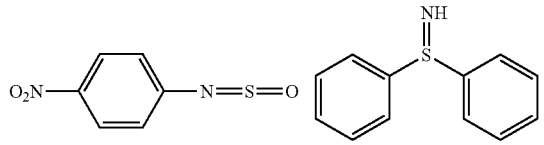

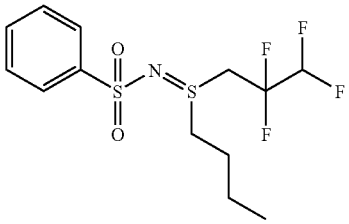

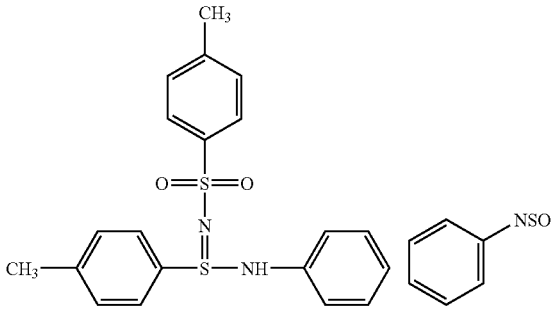

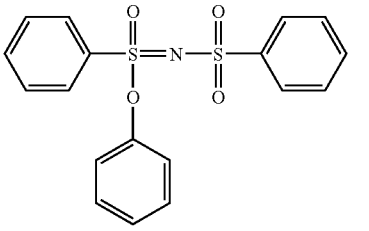

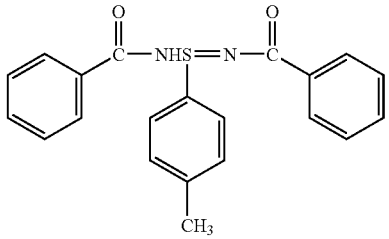

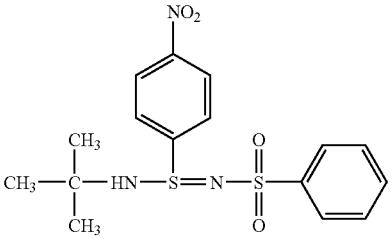

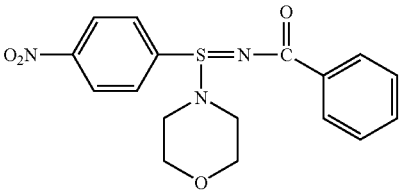

-continued

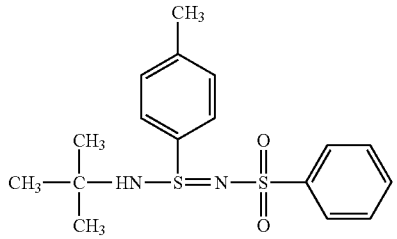

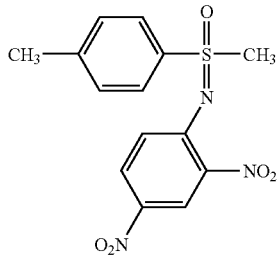

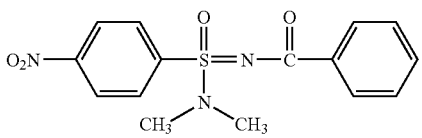

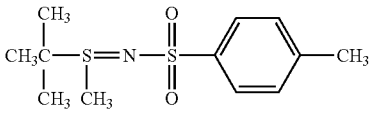

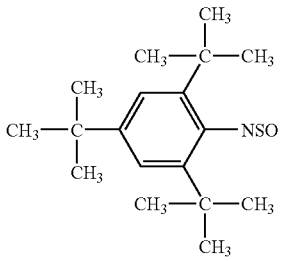

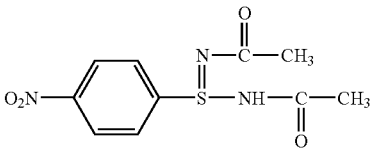

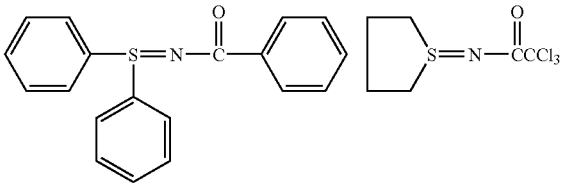

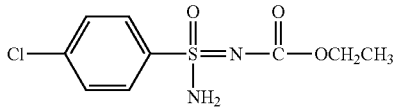

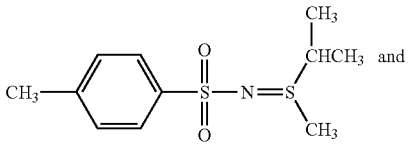

-continued

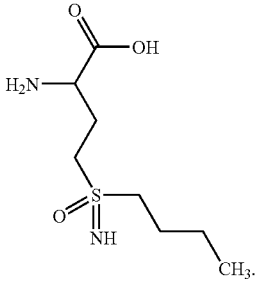

2. A photoconductor in accordance with claim 1 wherein said first layer is gold.

3. A photoconductor in accordance with claim 1 wherein said first layer is comprised of a gold containing material.

4. A photoconductor in accordance with claim 1 wherein said aminosilane is present in an amount of from about 50 to about 99 weight percent, said SN compound is present in an amount of from about 1 to about 50 weight percent, and wherein the total of said components in said undercoat layer is about 100 percent.

5. A photoconductor in accordance with claim 1 wherein said aminosilane is present in an amount of from about 75 to about 95 weight percent, said SN compound is present in an amount of from about 5 to about 25 weight percent, and wherein the total of said components in said undercoat layer is about 100 percent.

6. A photoconductor in accordance with claim 1 wherein said aminosilane is represented by

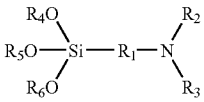

wherein $R_1$ is an alkylene group containing from 1 to about 25 carbon atoms; $R_2$ and $R_3$ are independently selected from the group consisting of at least one of hydrogen, alkyl containing from 1 to about 5 carbon atoms, and aryl containing from 6 to about 36 carbon atoms; and $R_4$, $R_5$ and $R_6$ are independently selected from an alkyl group containing from 1 to about 6 carbon atoms.

7. A photoconductor in accordance with claim 1 wherein said aminosilane is at least one of 3-aminopropyl triethoxysilane, N,N-dimethyl-3-aminopropyl triethoxysilane, N-phenylaminopropyl trimethoxysilane, triethoxysilyipropylethylene diamine, trimethoxysilyipropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and mixtures thereof; and said charge transport layer is comprised of 1, 2, 3, or 4 layers.

8. A photoconductor in accordance with claim 1 wherein said S N compound is present in an amount of from about 1 to about 20 weight percent.

9. A photoconductor in accordance with claim 1 wherein said SN compound is N,N'-bis(trimethylsilyl)sulfur diimide.

10. A photoconductor in accordance with claim 1 wherein said SN compound is N-thionylaniline, 4-nitro-N-sulfinylaniline, S,S-diphenylsulfilimine monohydrate, or N-(S-butyl (S-2,2,3,3-tetrafluoropropyl))-sulfanylidene)benzenesulfonamide.

11. A photoconductor in accordance with claim 1 wherein said undercoat layer is prepared by (a) hydrolyzing said aminosilane in water; (b) adding an acid catalyst thereto; and (c) adding said SN compound, and wherein said acid catalyst is selected from the group consisting of acetic acid, citric acid, formic acid, hydrogen iodide, phosphoric acid, hydrofluorosilicic acid, and p-toluene sulfonic acid.

12. A photoconductor in accordance with claim 1 wherein said aminosilane is 3-aminopropyl triethoxysilane, and said SN compound is N,N'-bis(trimethylsilyl)sulfur diimide, and the weight ratio thereof of said amino silane to said SN compound is from about 70/30 to about 95/5.

13. A photoconductor in accordance with claim 1 wherein the thickness of the undercoat layer is from about 0.01 to about 1 micron, and the thickness of the first layer functioning as a ground plane is from about 10 to about 50 nanometers.

14. A photoconductor in accordance with claim 1 wherein the thickness of the undercoat layer is from about 0.04 micron to about 0.5 micron.

15. A photoconductor in accordance with claim 1 wherein said charge transport layer is comprised of at least one of

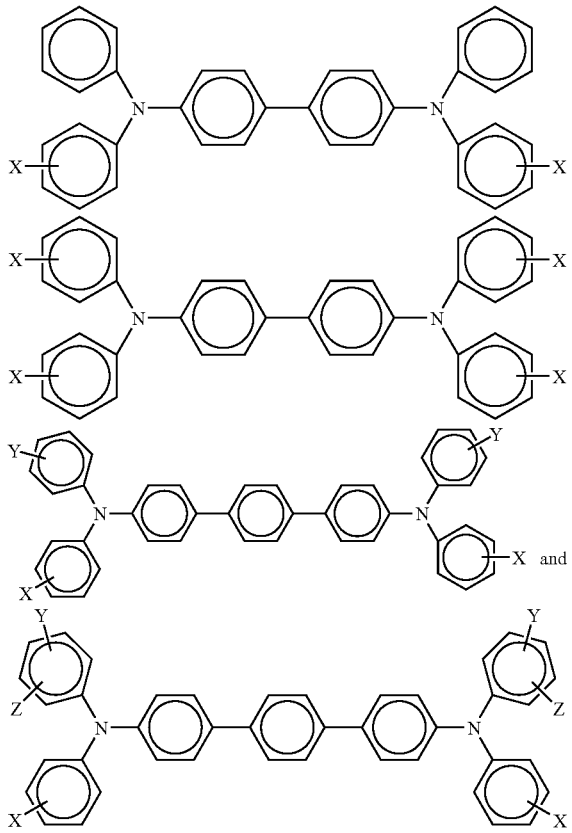

wherein X, Y, and Z are independently selected from the group consisting of alkyl, alkoxy, aryl, halogen, and mixtures thereof.

16. A photoconductor in accordance with claim 1 wherein said charge transport layer is comprised of a component selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N-diphenyl-N,N'-bis(3-chlorophenyl)-[p-terphenyl]-4,4'-diamine; and said aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilyl propylamino)ethylamino]-3-proprionate, (N,N'-dimethyl 3-amino)propyl triethoxysilane, N,N-dimethylaminophenyl triethoxysilane, and trimethoxysilyl propyldiethylene triamine.

17. A photoconductor in accordance with claim 1 wherein said photogenerating layer is comprised of at least one photogenerating pigment.

18. A photoconductor in accordance with claim 17 wherein said photogenerating pigment is comprised of at least one of a titanyl phthalocyanine, a hydroxygallium phthalocyanine, a halogallium phthalocyanine, a bisperylene, and mixtures thereof.

19. A photoconductor in accordance with claim 1 wherein said charge transport layer is comprised of a charge transport component and a resin binder, and wherein said photogenerating layer is comprised of at least one photogenerating pigment and a resin binder; and wherein said photogenerating layer is situated between said substrate and said charge transport layer; and wherein said aminosilane is represented by

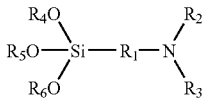

wherein $R_1$ is an alkylene group containing from 1 to about 25 carbon atoms; $R_2$ and $R_3$ are independently selected from the group consisting of at least one of hydrogen, alkyl containing from 1 to about 5 carbon atoms, and aryl containing from about 6 to about 36 carbon atoms; and $R_4$, $R_5$ and $R_6$ are independently selected from an alkyl group containing from 1 to about 6 carbon atoms.

20. A photoconductor in accordance with claim 1 wherein said undercoat layer further contains a resin binder selected from the group consisting of polyacetal resins, polyvinyl butyral resins, glycoluril resins, benzoguanamine resins, and mixtures thereof.

21. A photoconductor in accordance with claim 1 wherein said aminosilane is an aminoalkyl trialkoxy silane.

22. A photoconductor in accordance with claim 1 wherein said first layer is a ground plane layer of gold, said charge transport layer is comprised of an aryl amine and a polymeric binder, and said silane is an aminoalkyltrialkoxysilane.

23. A photoconductor in accordance with claim 1 wherein said first layer is a ground plane layer of gold, said charge transport layer is comprised of an aryl amine and a polymeric binder, and said silane is an aminoalkyltrialkoxysilane, and wherein said charge transport layer is comprised of a first charge transport layer and a second charge transport layer thereover.

24. A photoconductor in accordance with claim 1 wherein said SN compound is present in an amount of from about 1 to about 50 weight percent.

25. A photoconductor in accordance with claim 1 further including in said charge transport layer an antioxidant comprised of at least one of a hindered phenolic and a hindered amine.

26. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer.

27. A photoconductor comprising a substrate, a gold ground plane layer, an undercoat layer thereover comprised of a mixture of an aminosilane and a compound selected from the group consisting of N,N'-bis(trimethylsilyl)sulfur diimide, N-thionylaniline, 4-nitro-N-sulfinylaniline, S,S-diphenylsulfilimine monohydrate, and N-(S-butyl(S-2,2,3,3 tetrafluoropropyl))-sulfanylidene)benzenesulfonamide; a photogenerating layer, and at least one charge transport layer.

28. A photoconductor in accordance with claim 27 wherein said aminosilane is an aminoalkyl alkoxy silane, and said at least one is 1, 2 or 3 layers.

29. A photoconductor in accordance with claim 27 wherein said compound is N,N'-bis(trimethylsilyl)sulfur diimide.

30. A photoconductor in accordance with claim 27 wherein said aminosilane is represented by

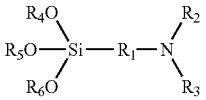

wherein $R_1$ is an alkylene; $R_2$ and $R_3$ are alkyl, hydrogen, or aryl; and each $R_4$, $R_5$ and $R_6$ is alkyl.

31. A photoconductor comprising in sequence a supporting substrate, a gold ground plane layer, a hole blocking layer comprised of a mixture of an aminosilane and N,N'-bis(trimethylsilyl)sulfur diimide, N-thionylaniline, 4-nitro-N-sulfinylaniline, S,S-diphenylsulfilimine monohydrate, or N-(S-butyl(S-2,2,3,3-tetrafluoropropyl)-sulfanylidene) benzenesulfonamide; a photogenerating layer, and a charge transport layer.

32. A photoconductor in accordance with claim 31 wherein said aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilyipropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, and trimethoxysilyl propyldiethylene triamine.

33. A photoconductor in accordance with claim 31 wherein said aminosilane is represented by

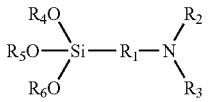

wherein $R_1$ is an alkylene; $R_2$ and $R_3$ are alkyl, hydrogen, or aryl; and each $R_4$, $R_5$, and $R_6$ is alkyl.

* * * * *